US005575740A

United States Patent [19]

Piaget et al.

[11] Patent Number: 5,575,740

[45] Date of Patent: Nov. 19, 1996

[54] STRIDING EXERCISER WITH UPWARDLY CURVED TRACKS

[76] Inventors: Gary D. Piaget, 1435 W. Silvermeadows Dr. #48; Trace O. Gordon, 3880 W. Lariat Rd., both of Park City, Utah 84060

[21] Appl. No.: 449,658

[22] Filed: May 24, 1995

Related U.S. Application Data

[63] Continuation of Ser. No. 129,592, Sep. 30, 1993, abandoned.

[51] Int. Cl.[6] ..... A63B 22/00; A63B 69/18

[52] U.S. Cl. ..... 482/70; 482/51

[58] Field of Search ..... 482/51, 52, 53, 482/70, 54, 142, 57, 91, 92, 148, 71; 434/247, 255; D21/191–199

[56] References Cited

U.S. PATENT DOCUMENTS

| | | | |
|---|---|---|---|
| D. 78,474 | 8/1928 | Matheson . | |
| 139,924 | 6/1873 | Shaler . | |
| D. 205,405 | 8/1966 | Tofsuka . | |
| 219,439 | 9/1879 | Blend | 482/51 |
| D. 299,369 | 1/1989 | Smith et al. . | |
| D. 303,131 | 8/1989 | Lo . | |
| D. 328,934 | 8/1992 | Friedebach . | |
| D. 330,399 | 10/1992 | Furline . | |
| D. 340,095 | 10/1993 | Friedebach . | |
| D. 343,214 | 1/1994 | Easley et al. . | |
| D. 344,557 | 2/1994 | Ashby . | |
| D. 345,593 | 3/1994 | Gerschefske et al. . | |
| D. 345,998 | 4/1994 | Gresko . | |
| D. 348,494 | 7/1994 | Ashby . | |
| D. 349,931 | 8/1994 | Bostic et al. . | |
| D. 351,435 | 10/1994 | Peterson et al. . | |
| D. 351,633 | 10/1994 | Bingham . | |
| 1,211,765 | 1/1917 | Schmidt . | |
| 1,909,190 | 5/1933 | Sachs . | |
| 2,183,345 | 12/1939 | Brandon . | |
| 2,772,881 | 12/1956 | Fundom . | |
| 2,842,365 | 7/1958 | Kelley | 482/51 |
| 2,906,532 | 9/1959 | Echols . | |
| 2,969,060 | 1/1961 | Swada et al. . | |
| 3,566,861 | 3/1971 | Weiss . | |
| 3,582,069 | 6/1971 | Flick et al. . | |
| 3,637,206 | 1/1972 | Chickering, III . | |
| 3,642,279 | 2/1972 | Cutter . | |
| 3,759,511 | 9/1973 | Zinkin et al. . | |
| 3,912,264 | 10/1975 | Busse et al. . | |
| 4,023,795 | 5/1977 | Pauls . | |
| 4,176,836 | 12/1979 | Coyle | 482/92 |
| 4,389,047 | 6/1983 | Hall . | |
| 4,402,506 | 6/1983 | Jones . | |
| 4,434,981 | 3/1984 | Norton . | |

(List continued on next page.)

FOREIGN PATENT DOCUMENTS

| | | | |
|---|---|---|---|
| 1223905 | 7/1987 | Canada . | |
| 2481599 | 11/1981 | France . | |
| 0579401 | 9/1976 | Switzerland | 482/71 |
| 1489772 | 6/1989 | U.S.S.R. . | |
| 2043464 | 10/1980 | United Kingdom | 482/54 |

*Primary Examiner*—Stephen R. Crow
*Attorney, Agent, or Firm*—Salter & Michaelson

[57] ABSTRACT

A striding exercise device includes a base having two elongated parallel tracks which curve upwardly in a constant radial arc, and two footskates which are rotatably supported on the tracks for reciprocating movement thereon. The radial arc generally corresponds to the natural swinging arc of a human leg as the leg pivots about the hip. When the operator stands on the footskates and reciprocates the footskates back and forth along the upwardly curved tracks, the operator's torso is maintained in a stationary and balanced position over the base. The reduction in torso movement substantially eliminates strain on the leg joints, particularly the knee and hip joints, caused by up and down movement of the torso and further substantially eliminates back strain caused by reaching and bending at the waist.

13 Claims, 3 Drawing Sheets

U.S. PATENT DOCUMENTS 4,512,571 8/1985 Hermelin .
4,529,194 7/1985 Haaheim .
4,618,139 10/1986 Haaheim .
4,632,385 12/1986 Geraci .
4,645,200 2/1987 Hix .
4,743,015 5/1988 Marshall .
4,802,856 2/1989 Olson .
4,804,178 2/1989 Friedebach .
4,813,667 3/1989 Watterson .
4,850,585 7/1989 Dalebout .
4,861,023 8/1989 Wedman .
4,911,430 3/1990 Flament .
4,940,233 7/1990 Bull .
4,948,121 8/1990 Haaheim et al. .
4,960,276 10/1990 Feuer et al. .
4,989,858 2/1991 Young et al. .
5,000,442 3/1991 Dalebout et al. .
5,087,033 2/1992 Tagney et al. .
5,102,380 4/1992 Jacobson et al. .
5,104,363 4/1992 Shi .
5,108,093 4/1992 Watterson .
5,110,117 5/1992 Fisher et al. .
5,145,481 9/1992 Friedebach .
5,147,257 9/1992 Loane .
5,171,196 12/1992 Lynch .
5,181,894 1/1993 Shieng ..... 482/70
5,226,866 7/1993 Engel et al. .
5,232,423 8/1993 Hajduczek ..... 482/66
5,242,343 9/1993 Miller ..... 482/57
5,246,412 9/1993 Chen .
5,277,678 1/1994 Friedebach et al. .
5,279,528 1/1994 Dalebout et al. .
5,299,996 4/1994 Chi .
5,302,162 4/1994 Pasero .
5,320,589 6/1994 Singleton et al. .
5,336,141 8/1994 Vittone .
5,336,146 8/1994 Piaget et al. .
5,342,264 8/1994 Gordon .
5,344,372 9/1994 Hung .
5,372,559 12/1994 Dalebout et al. .
5,374,228 12/1994 Buisman et al. .

STRIDING EXERCISER WITH UPWARDLY CURVED TRACKS

This is a continuation of application Ser. No. 08/129,592, filed Sep. 30, 1993, now abandoned

BACKGROUND AND SUMMARY OF THE INVENTION

The instant invention relates to exercise apparatus and more particularly to a striding exerciser which simulates the natural exercise of walking.

Walking, jogging, and cross-country skiing have been found to be effective activities for exercising the body, and in particular, the legs, heart and lungs. However, these activities are primarily outdoor activities which can be severely limited by adverse weather and geographic conditions. The limitations of traditional outdoor exercise activities have in some respects been resolved by the development of indoor exercise devices which simulate particular exercise activities. In this regard, a wide variety of walking, striding and cross-country skiing devices have heretofore been known in the art. In this connection, the U.S. Patents to Dalebout U.S. Pat. No. 4,850,585; Hix U.S. Pat. No. 4,654,200; Bull et al U.S. Pat. No. 4,940,233; and Friedebach U.S. Pat. No. 4,804,178 are thought to be particularly relevant to the instant invention.

The patent to Friedebach discloses a cross-country skiing device comprising a pair of parallel horizontal rails and a pair of footplates which are movably supported on the rails. The Friedebach cross-country skiing device further includes a belt mechanism which causes the footplates to move in unison in opposite directions. Still further, the skiing device includes two independent hand levers which pivot back and forth to simulate the movement of cross-country ski poles. In use, the operator stands upon the footplates, and reciprocates the footplates back and forth while simultaneously pushing and pulling the hand levers. While the Friedebach cross-country skiing device is capable of providing a significant aerobic workout, it has been found that it also places a tremendous amount of stress on the operator's back and leg joints. The reciprocating movement of the feet along a horizontal path causes the operator's torso to move up and down, thereby forcing the operator to continuously lift his/her body weight with each stride. In addition, the up and down lifting motion of the torso increases the stress placed on the leg joints, particularly the hip and knee joints. Still further, the pushing and pulling of the hand levers forces the operator to bend over and reach from the waist which unnecessarily stresses the back muscles. Accordingly, it has been found that persons who have back, knee or hip problems often find it uncomfortable, painful, or even impossible to utilize ski-type exercise machines.

The patents to Dalebout, Hix and Bull et al disclose devices which are commonly referred to as striding-type exercisers. Striding-type exercisers typically comprise a pair of spaced vertical frame members, and a pair of swinging leg members which are pivotably mounted on the vertical frame members. In use, the operator stands on platforms which are mounted at the ends of the swinging leg members and reciprocates his/her legs back and forth in a swinging motion between the vertical frame members. The swinging movement of the legs in a striding-type exerciser provides substantially the same aerobic benefits as the Friedebach cross-country ski exerciser; however, the striding exerciser balances the user in a more stable position, reduces the up and down movement of the operator's torso and reduces strain on the back and leg joints. When a striding-type exerciser includes hand levers, the levers usually rotate about a point which does not require the operator to bend or reach during movement. While striding exercisers have been found to be highly effective in providing a low stress aerobic workout, they have several design problems which prevents their widespread marketability and use. Striding exercise devices generally require heavy duty frame members and heavy duty bearings to accommodate the weight of the operator on the pivot mechanisms. As a result, these machines are too bulky and too heavy for use within the home.

In addition, the heavy duty construction makes striding exercisers too costly to compete with other less expensive exercise devices. Accordingly, striding exercisers are usually only found in institutional rehabilitation centers and large scale exercise facilities that have substantial funds for purchasing and maintaining these machines. In addition, it has been found that the design of the prior art striding exercisers creates somewhat of a safety hazard in that the vertical frame members of the striding-type exerciser prevent mounting of the exerciser from a side position. The current striding exercisers are designed so that the operator must mount the machine from the rear. When the operator first steps onto one of the platforms, the platform tends to pivot forwardly, thereby throwing the operator off balance before being able to step up with the opposite foot. It can therefore be seen that operators who are not familiar with mounting the machine may be thrown off balance and fall to the floor while mounting the machine.

The instant invention provides a novel and inexpensive striding-type exerciser which overcomes the disadvantages of the prior art. Briefly, the instant striding exerciser comprises a base having a pair of elongated parallel tracks which curve upwardly in a continuous arc, a pair of footskates rotatably supported on the upwardly curved tracks for reciprocating movement thereon, and a pulley mechanism for moving the footskates in unison in opposite directions. The upward curvature of the tracks generally corresponds to the natural swinging arc of a human leg so that when the operator stands on the footskates, and reciprocates the footskates back and forth on the tracks, the operator's torso remains in a stationary and balanced position over the base.

Accordingly, it is an object of the instant invention to provide an exercise device which simulates the natural exercise of walking.

It is another object to provide an exercise device which aerobically conditions the user's cardiovascular system without the muscle and joint strain commonly associated with conventional exercise machines.

It is another object to provide a striding exerciser having a base with upwardly curved tracks that follow the natural swinging arc of the leg.

It is yet another object to provide a striding exerciser which maintains the user's torso in a stationary and balanced position over the track.

It is an even further object to provide a striding exerciser that is simple in design, easy to construct, and inexpensive to manufacture.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
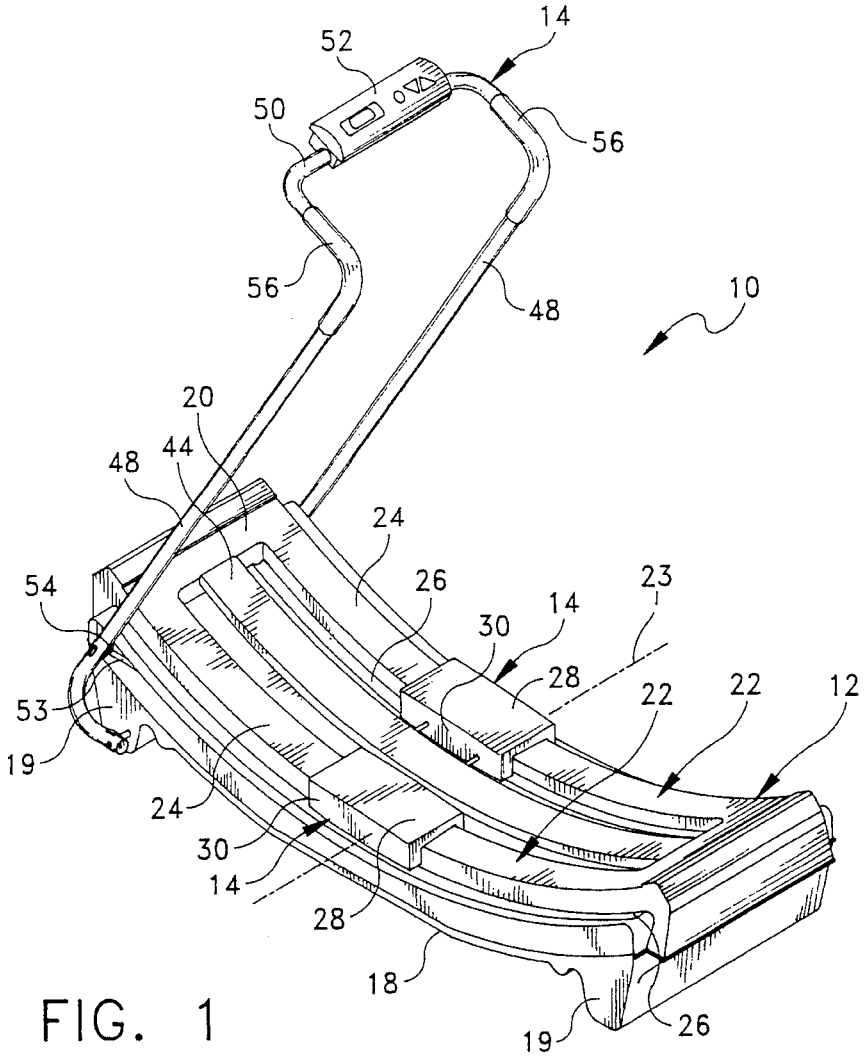
FIG. 1 is a perspective view of the striding exerciser of the instant invention.
Figure 2:
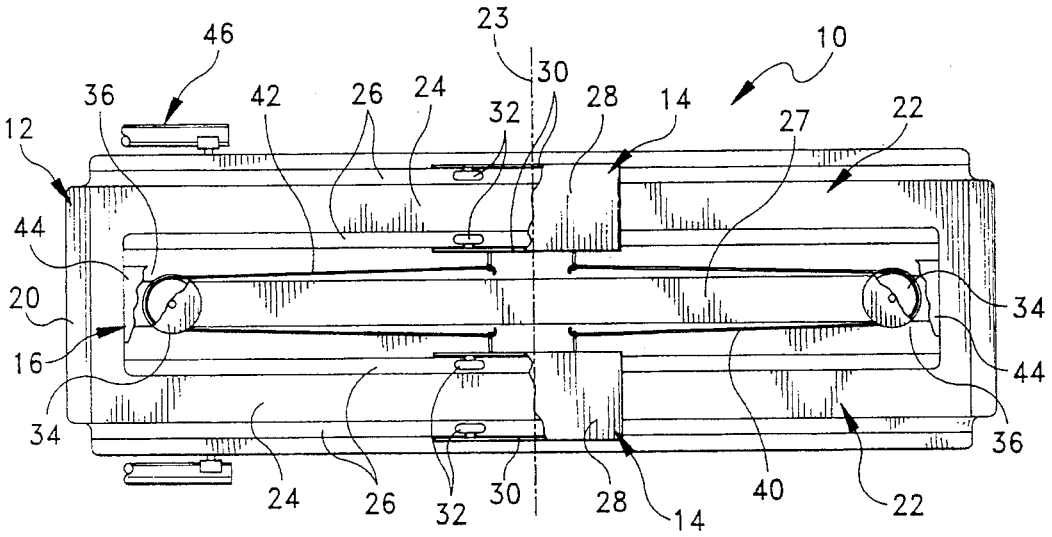
FIG. 2 is a top view thereof with the base cover and the handlebars removed for purposes of illustration.
Figure 3:
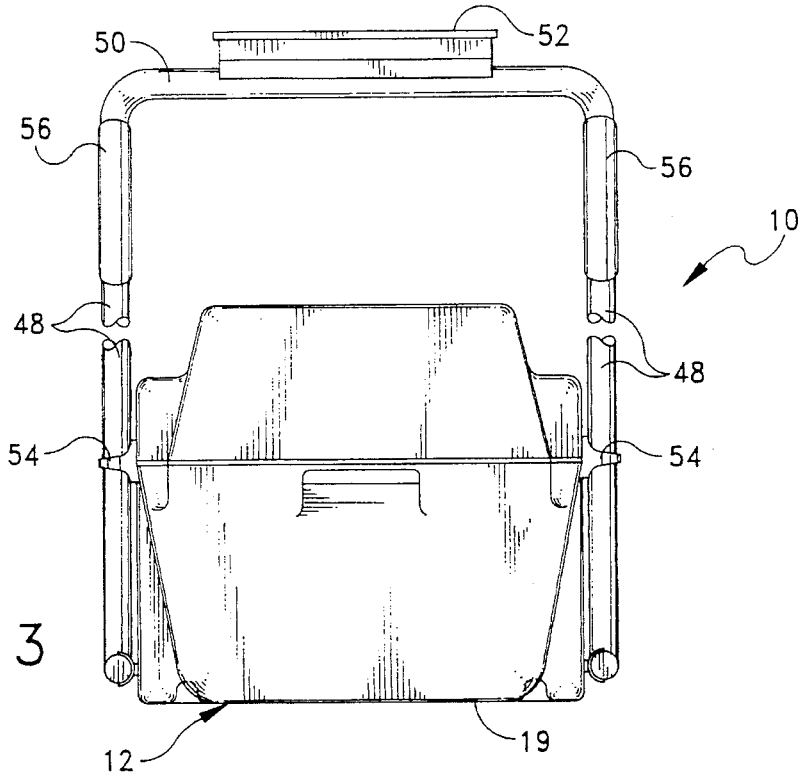
FIG. 3 is a front view thereof.
Figure 4:
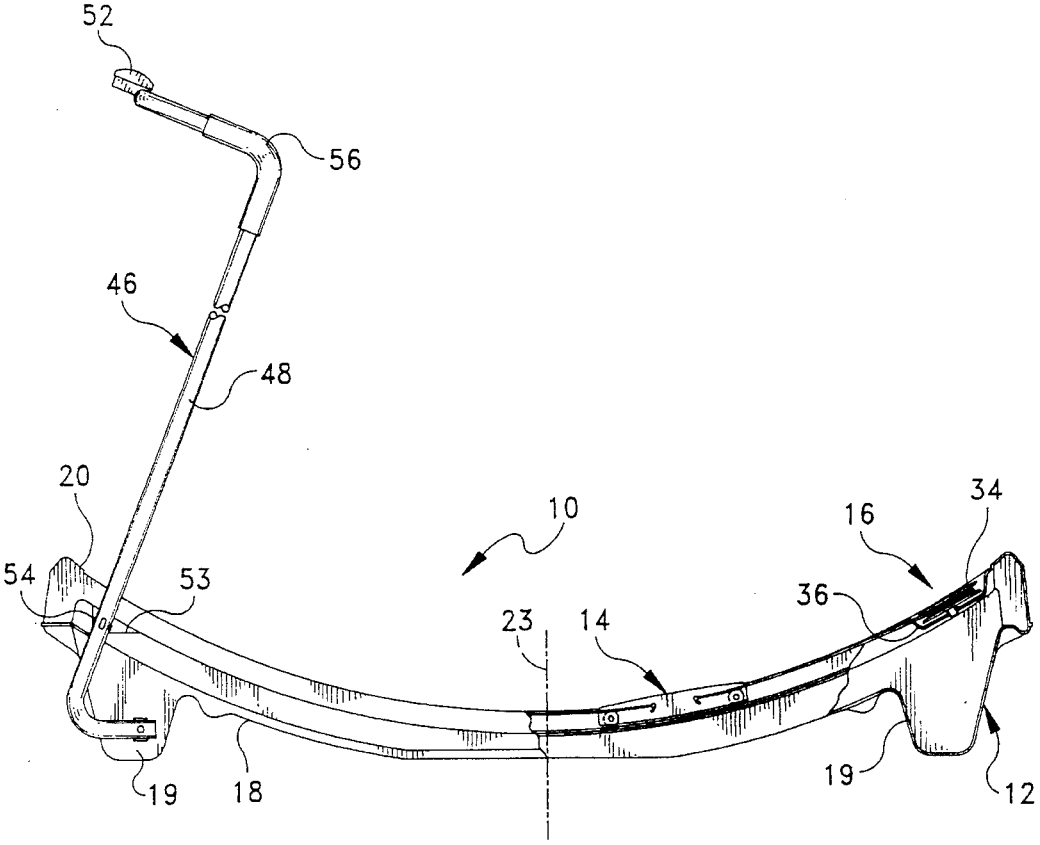
FIG. 4 is a cross-sectional view thereof taken along line 4—4 in FIG. 1.
Figure 5:
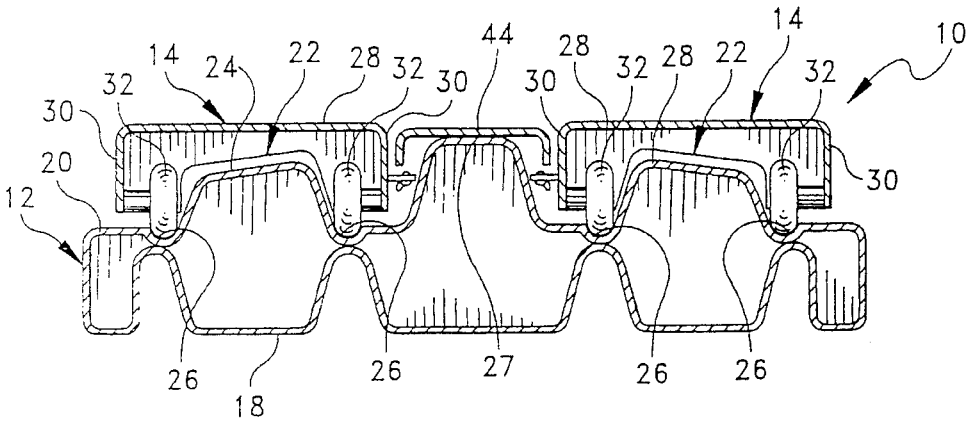
FIG. 5 is a cross-sectional view thereof taken along line 5—5 in FIG. 1.

Referring now to the drawings, the striding exerciser-of the instant invention is illustrated and generally indicated at 10 in FIGS. 1–5. As will hereinafter be more fully described, the instant invention provides an inexpensive striding exerciser 10 which aerobically conditions the operator's cardiovascular system without the muscle and joint strain commonly associated with conventional exercise machines. The striding exerciser 10 generally comprises a curved base generally indicated at 12, two footskates generally indicated at 14 which are movably supported on the base 12, and a pulley mechanism generally indicated at 16 (FIG. 2) which is operative for moving the footskates 14 in unison in opposite directions. More specifically, the base 12 comprises an integrally formed, blow-molded body having a contoured lower side 18, spaced legs 19 for supporting the base 12 on a flat supporting surface, and a contoured upper side 20. The contoured upper side 20 includes two elongated parallel tracks generally indicated at 22 which curve upwardly in a continuous arc. The upward curvature of the tracks 22 generally corresponds to the natural swinging arc of a human leg as it pivots about its hip joint. In this connection, the track is preferably a constant radial arc, however it may be slightly out of round if desired. As illustrated in the exemplary embodiment of FIG. 4, the arc is substantially symmetrical about a transverse centerline 23 of the base 12. As will be explained hereinafter, the symmetric arc maintains the operator in a balanced and stationary positions on the base. Each of the tracks 22 includes a center ridge 24 and two spaced grooves 26 on either side of the ridge 24 which are adapted for supporting the footskates 14. (See FIG. 5). The contoured upper side 20 further includes an elongated central ridge 27 (Also see FIG. 5) which longitudinally extends between the two tracks 22. While the base 12 is specifically described herein as comprising an integrally formed unit, it is to be understood that the base 12 may also be constructed from tubular metal elements, wherein the upwardly curved tracks are formed from parallel rails.

The footskates 14 are generally U-shaped (FIG. 5), and they comprise a horizontal body portion 28 for receiving the operator's foot thereon, two downwardly extending leg portions 30, and four skatewheels 32 which are rotatably mounted to the leg portions 30. The body portion 28 of the footskate 14 is received over the center ridge 24 of the respective track 22 so that the wheels 32 ride in the spaced grooves 26 on both sides of the ridge 24. It can thus be seen that the footskates 14 are movable back and forth along the length of the tracks 22.

The pulley mechanism 16 is attached to both footskates 14, and it is operative for causing the footskates 14 to move in unison in opposite directions during use. The pulley mechanism 16 comprises two pulleys 34 which are respectively mounted in depressions 36 formed at the front and rear ends of the central ridge 26, and a cord generally indicated at 38 (FIG. 2) which is attached to the footskates 14 and extends around the pulleys 34 to form a continuous loop. More specifically, there is a first cord section 40 which is attached to the rear end of one of the footskates 14 and extends around the rear pulley 34 and is attached to the rear end of the other footskate 14. Likewise, there is a second cord section 42 which is attached to the front end of the first footskate 14 and extends around the front pulley 34 and is attached to the front end of the other footskate 14. It can therefore be seen that when one of the footskates 14 is moved forward in its track, the other footskate 14 is moved rearwardly in its track. In order to conceal the pulleys 34 and cord sections 40 and 42 from sight, and to prevent the operator's feet from becoming entangled with the cord sections 40 and 42 during use, the base 12 is provided with a cover 44 which is releasably mounted over the central ridge 26. The cover 44 also retains the cord sections 40 and 42 so that they conform to the curved shape of the base 12.

The striding exerciser 10 further includes a set of handlebars generally indicated at 46 which are connected to the front end of the base 12. The handlebars 46 include two downwardly extending arm portions 48 which are pivotally connected to the sides of the base 12 and a horizontal body portion 50 which is operative for supporting an electronic display unit 52. The pivotal connection of the arm portions 48 enables the handlebars 46 to be pivoted downwardly out of the way so that the entire exercise device 10 may be more easily transported and stored. In order to maintain the handlebars 46 in a stable and upright position, the sides of the base 12 include two triangular depressions 53 which are operative for frictionally receiving circular support members 54 mounted to the arm portions 48. The arm portions 48 of the handlebars 46 further include rubber or foam pad hand grips 56 for the operator to grasp during use. The electronic display unit 52 is operative for measuring time, calories or other information related to use of the apparatus 10.

In use, the operator stands on the footskates 14, grasps the rubber pad hand grips 56 on the handlebars 46, and reciprocates the footskates 14 back and forth along the upwardly curved tracks 22. While the handlebars 46 are provided to help maintain balance during use, it has been found that the instant striding exerciser 10 so well balances the user over the base that the use of the handlebars 46 is really not necessary during operation. In this connection, operators may wish to swing their arms as would be normal when walking and, in addition, to utilize hand weights in order to increase the aerobic benefits of the this exercise. The upward curvature of the tracks 22 corresponds with the natural swinging arc of the operator's leg, and maintains the operator's torso in a stationary and balanced position over the base 12. In other words, the curvature of the tracks of the exemplary embodiment substantially immobilizes vertical movement of the operator's center of gravity during reciprocating motion of the feet. The curved tracks 22 allow the operator's legs to naturally pivot around their hip joint without requiring the legs to lift the body or torso upwardly with each stride. Because the legs are not required to continuously lift the operator's weight, there is virtually no strain placed on the leg joints, especially the ankle, knee and hip joints. In addition, the stationary position of the torso substantially eliminates the back strain commonly associated with repetitive bending and reaching in conventional cross-country ski machines. The combined effect is to virtually eliminate physical stress on both the back and legs of the operator, while providing an effective aerobic workout.

It is also pointed out that the instant striding exerciser 10 is mounted from the side which allows the user to balance their weight to the side so that the footskates do not slide forward and backward while mounting the device 10.

Figure 6:
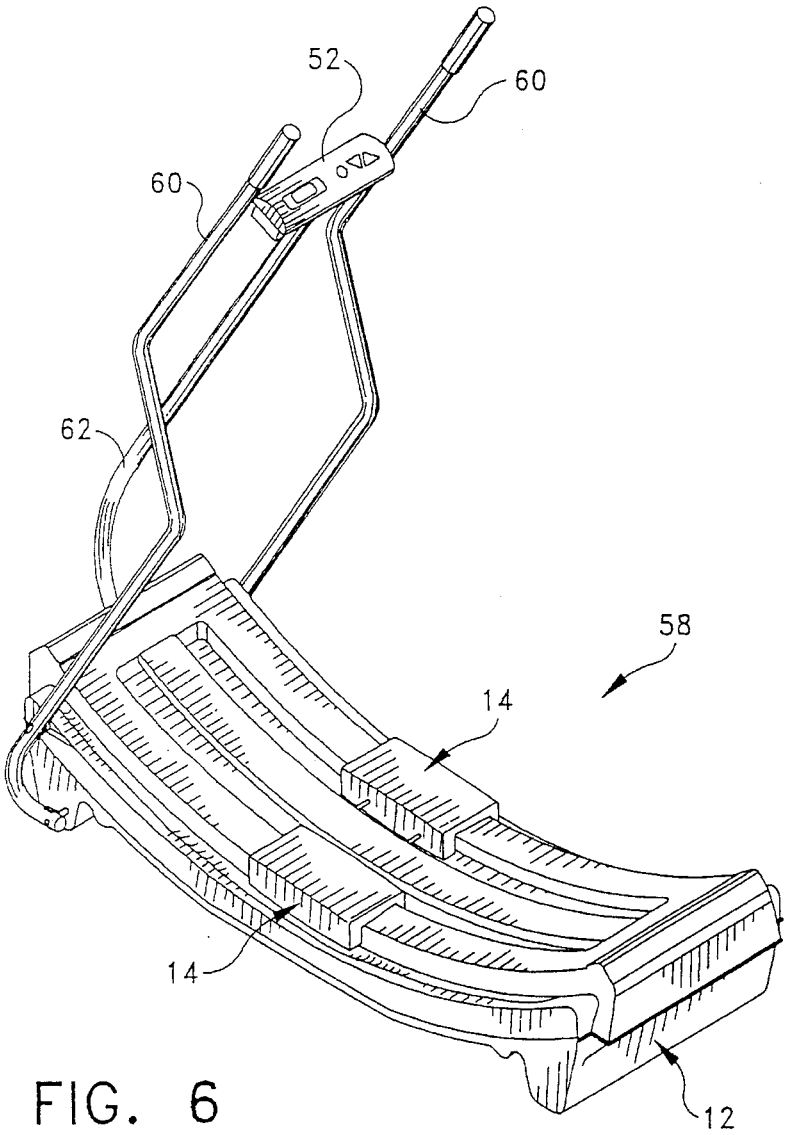
FIG. 6 is a perspective view of a second embodiment of the instant exercise apparatus.

A second embodiment of the striding exerciser is illustrated and generally indicated at 58 in FIG. 6. In the second embodiment 58, the handlebars 46 are replaced by two pivotable hand levers 60. The hand levers 60 are mounted to the sides of the base 12 by means of rotatable couplings (not shown) which have conventional resistance means for adjusting the resistance level of movement of the hand levers 60. The hand levers 60 provide a means for simultaneously working out the upper body during use of the exerciser 10. The operator simply grasps the hand levers 60 and reciprocates them in opposite directions to the footskates 14. In order to support the electronic display unit 52 in the second embodiment 58, the exerciser 10 is provided with a center column support 62 which is attached at the front of the base 12.

It can therefore be seen that the instant invention provides a unique and effective striding exerciser for exercising the operator's cardiovascular system without the muscle and joint stress commonly associated with conventional exercise devices. The upwardly curved radius of the tracks 22 effectively maintains the operator's torso in a stationary and balanced position over the base 12 thereby reducing the back and leg strain. Further, the instant striding exerciser allows side mounting which is easier and safer than the prior art, rear mounting striding exercisers. Still further, the instant exercise device 10 is inexpensive to manufacture, simple and fun to operate, and collapsible to facilitate transportation and storage. These unique features are not offered by the prior art exercise devices. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A striding exercise device comprising:

a base including two elongated parallel tracks which curve upwardly in a continuous arc, said tracks each including a center ridge and two spaced grooves respectively positioned on opposing sides of said center ridge, said continuous arc having a curvature which generally corresponds to a natural swinging arc of a human leg as it pivots around its hip joint, said base having a transverse centerline, said curvature being generally symmetrical about said transverse centerline; and footskate means respectively movably supported on said parallel tracks, for receiving feet of an operator thereon, wherein said operator reciprocates said feet back and forth so that said footskate means move in reciprocating motion along said upwardly curved tracks, said user having a center of gravity, said curvature generally immobilizing vertical movement of said center of gravity of said operator during said reciprocating motion.

2. The exercise device of claim 1 further comprising means for moving said footskate means in unison in opposite directions along said tracks.

3. In the exercise device of claim 2, said means for moving said footskate means in unison comprising two pulleys which are respectively mounted between said parallel tracks at front and rear ends of said base, and a cord which extends along said tracks and around said pulleys to form a continuous loop, said cord being attached to said footskates so that as one footskate moves forward on said track, the opposite footskate moves backward on said track.

4. The exercise device of claim 1 further comprising two arm levers which are pivotally mounted at opposite sides of said base.

5. In the exercise device of claim 4, said arm levers including means for adjusting a tension level thereof.

6. The exercise apparatus of claim 1 further comprising handlebar means for supporting an operator during reciprocating movement of said footskate means.

7. In the exercise apparatus of claim 1, said continuous arc comprising a constant radial arc.

8. A striding exercise device comprising:

a base including a bottom surface for supporting said base on a flat supporting surface, and a contoured upper surface, said contoured upper surface including two elongated parallel tracks which curve upwardly in a continuous arc, said tracks each including a center ridge and two space grooves respective positioned of opposing sides of said center ridge, said continuous arc having a curvature which generally corresponds to a natural swinging arc of a human leg as it pivots around its hip joint, said base having a transverse centerline, said curvature being generally symmetrical about said transverse centerline;

footskate means respectively movably supported on said parallel tracks for reciprocating movement thereon, said user having a center of gravity, said curvature generally immobilizing vertical movement of said center of gravity of said operator during said reciprocating movement; and means for moving said footskate means in unison in opposite directions along said tracks, said means for moving said footskate means comprising two pulleys which are respectively mounted between said parallel tracks at front and rear ends of said base, and cord means extending along said tracks and around said pulleys to form a continuous loop with said footskate means so that as one footskate means moves forward on said track, the opposite footskate means moves backward on said track.

9. In the exercise apparatus of claim 8, said continuous arc comprising a constant radial arc.

10. In the exercise device of claim 1, said base comprising a one-piece blow-molded entity having a contoured upper surface with two elongated upwardly curved tracks therein.

11. In the exercise device of claim 8, said base comprising a one-piece blow-molded entity.

12. A striding exercise device comprising:

a base including two elongated parallel tracks which curve upwardly in a continuous arc, said continuous arc having a curvature which generally corresponds to a natural swinging arc of a human leg as it pivots around its hip joint, said base having a transverse centerline, said curvature being generally symmetrical about said transverse centerline;

footskate means respectively movably supported on said parallel tracks for receiving feet of an operator thereon; and means for confining said footskate means on said tracks to provide linear parallel movement of said footskate means on said tracks, said operator reciprocating said feet back and forth so that said footskate means move in linear parallel reciprocating motion along said upwardly curved tracks, said user having a center of gravity, said curvature generally immobilizing vertical movement of said center of gravity of said operator during said reciprocating motion.

13. A striding exercise device comprising:

a base including a bottom surface for supporting said base on a flat supporting surface, and a contoured upper surface, said contoured upper surface including two elongated parallel tracks which curve upwardly in a continuous arc, said continuous arc having a curvature which generally corresponds to a natural swinging arc of a human leg as it pivots around its hip joint, said base having a transverse centerline, said curvature being generally symmetrical about said transverse centerline;

footskate means respectively movably supported on said parallel tracks for reciprocating movement thereon;

means for confining said footskate means on said tracks to provide linear parallel movement of said footskate means on said tracks, said user having a center of gravity, said curvature generally immobilizing vertical movement of said center of gravity of said operator during said reciprocating movement; and means for moving said footskate means in unison in opposite directions along said tracks, said means for moving said footskate means comprising two pulleys which are respectively mounted between said parallel tracks at front and rear ends of said base, and cord means extending along said tracks and around said pulleys to form a continuous loop with said footskate means so that as one footskate means moves forward on said track, the opposite footskate means moves backward on said track.

* * * * *